US008821590B2

(12) United States Patent
Corbellini et al.

(10) Patent No.: US 8,821,590 B2
(45) Date of Patent: Sep. 2, 2014

(54) AQUEOUS TEXTILE TREATMENT

(75) Inventors: Francesca Corbellini, Duesseldorf (DE); Elisabeth Baumgarten, Duisburg (DE); Hans Bouten, Geldern (DE); Arndt Scheidgen, Essen (DE)

(73) Assignee: Henkel AG & Co. KGaA, Dusseldorf (DE)

( * ) Notice: Subject to any disclaimer, the term of this patent is extended or adjusted under 35 U.S.C. 154(b) by 971 days.

(21) Appl. No.: 12/940,108

(22) Filed: Nov. 5, 2010

(65) Prior Publication Data

US 2011/0041257 A1 Feb. 24, 2011

Related U.S. Application Data

(63) Continuation of application No. PCT/EP2009/055547, filed on May 7, 2009.

(30) Foreign Application Priority Data

May 9, 2008 (DE) ..... 10 2008 023 014

(51) Int. Cl.

| | |
|---|---|
| ***C11D 1/00*** | (2006.01) |
| ***C11D 1/65*** | (2006.01) |
| ***D06L 3/00*** | (2006.01) |
| ***D06L 3/16*** | (2006.01) |
| ***C11D 7/26*** | (2006.01) |
| ***C11D 3/39*** | (2006.01) |
| ***C11D 9/42*** | (2006.01) |
| ***C11D 3/20*** | (2006.01) |
| ***C11D 11/00*** | (2006.01) |

(52) U.S. Cl.

CPC ..... *C11D 3/3947* (2013.01); *C11D 7/265* (2013.01); *C11D 9/42* (2013.01); *C11D 3/2079* (2013.01); *C11D 11/0017* (2013.01)

USPC ..... 8/137; 510/303; 510/309; 510/363; 510/367; 510/370; 510/375; 510/376; 510/461; 252/186.43

(58) Field of Classification Search

USPC ..... 252/186.43; 8/111–137; 510/208, 209, 510/276, 285, 367, 370, 405, 303, 309, 363, 510/375, 376, 461

See application file for complete search history.

(56) References Cited

U.S. PATENT DOCUMENTS

| | | | | | |
|---|---|---|---|---|---|
| 5,855,625 | A * | 1/1999 | Maurer et al. | ..... | 8/137 |
| 6,106,854 | A * | 8/2000 | Belfer et al. | ..... | 424/405 |
| 6,225,271 | B1 | 5/2001 | Wright, Jr. et al. | | |
| 6,380,142 | B1 | 4/2002 | Vogt et al. | | |
| 6,451,064 | B1 | 9/2002 | Del Duca et al. | | |
| 6,482,786 | B1 * | 11/2002 | Del Duca et al. | ..... | 510/309 |

FOREIGN PATENT DOCUMENTS

| | | | | | |
|---|---|---|---|---|---|
| EP | 0913462 | A1 | 5/1999 | | |
| EP | 0962520 | A1 | 12/1999 | | |
| JP | 2005531457 | A * | 11/2005 | ..... | C11D 1/02 |
| WO | 9626999 | A1 | 9/1996 | | |

OTHER PUBLICATIONS

Furukawa, M. et al. "Bleach-cleaning agent composition for bleach-cleaning of textiles, contains preset amount of hydrogen peroxide and oleic acid, stearic acid, linoleic aci, palmitic acid, and/or their alkali or alkaline-earth metal salts." Thomson Scientific, Jul. 22, 2009, XP002537614, Database Accession No. 2005-801528.

"Detergents for cleaning blood-stained textiles—using soln. contg. polyethylene glycol monolaurl ether and ethylene oxide- propylene oxide copolymer." Thomson Scientific, Jul. 22, 2009, XP002537615, Database Accession No. 1975-39984W.

* cited by examiner

*Primary Examiner* — Tri V Nguyen

(74) *Attorney, Agent, or Firm* — Ingrassia Fisher & Lorenz, P.C.

(57) ABSTRACT

Liquid hydrous laundry treatment agent containing hydrogen peroxide and omega-6 fatty acid, and optionally further ingredients compatible with said components.

11 Claims, No Drawings

AQUEOUS TEXTILE TREATMENT

CROSS REFERENCE TO RELATED APPLICATIONS

The present application is a continuation of International Patent Application No. PCT/EP2009/055547 filed 7 May 2009, which claims priority to German Patent Application No. 10 2008 023 014.6 filed 9 May 2008, both of which are incorporated herein by reference.

The present invention relates to an aqueous bleaching agent based on hydrogen peroxide that is suitable for direct utilization as a laundry treatment agent, as well as an additive in typical washing methods.

In order to remove stubborn stains (a/k/a "spots") from textiles, the textiles are often treated with special pretreatment agents prior to the actual washing process. If the problem involves removal of bleachable stains, peroxide-containing pretreatment agents are typically used. Because application prior to the wash is easier, such pretreatment agents are often liquid and either poured onto the stain or applied with the aid of a cloth or sponge, either directly or optionally after dilution with water. Presently, improved removal of bleachably treated spots from textiles is accomplished by subsequently subjecting the textile to an ordinary household washing process by way of an intensive and extended contact time for the peroxide-containing agent. In addition to automatic washing methods, hand laundering can also be used in this context.

With respect to liquid and hydrous bleaching agents, a more or less pronounced decrease in their bleaching performance is often observed after the agents are stored. This decrease in performance can be attributed to a reduction in the quantity of active bleaching substance. It is known, for example, that aqueous hydrogen peroxide formulations decompose due to the presence of heavy-metal ions such as iron, copper, nickel, cobalt, or manganese ions. To combat this problem, there have been many proposals to add complexing agents for heavy-metal ions to the liquid and hydrous bleaching agent (e.g., in International Patent Application WO 96/26999). Decrease in concentration of the peroxide bleaching agent is also observed with intensive light irradiation. In this respect, European Patent Application EP 0 913 462 proposes that aqueous liquid preparations containing monopersulfate be packaged in UV-opaque receptacles. It is also known from European Patent Application EP 1 092 762 that 1-hydroxybenzotriazole and a plurality of its substituted derivatives can increase shelf stability of peroxygen compounds in aqueous formulations.

With respect to relatively small, locally delimited stains, it is often not desirable to wash the entire affected textile in order to remove the spot completely, even if the stained location has been subjected to pretreatment. Instead, there is a demand for the ability to remove a spot from a textile element that has been only briefly taken off, or to be able to remove stains from textiles while the textile is still on the body. In both instances, such an agent must not only have good spot removal performance, but also be harmless for direct contact with human skin.

The present invention, which intends to make a contribution to this, is directed towards a liquid hydrous bleaching agent or laundry treatment agent containing hydrogen peroxide and omega-6 fatty acid, as well as further optional ingredients compatible with these two components.

The agent preferably contains 0.1 wt % to 5 wt %, particularly 0.5 wt % to 4 wt %, and even more particularly 0.9 wt % to 2 wt % hydrogen peroxide, based on total weight of the agent. When manufacturing such agents, it is also possible to proceed from more highly concentrated hydrogen peroxide.

Omega-6 fatty acids are unsaturated fatty acids having a carbon-carbon double bond in the omega-6 position (i.e., at the sixth bond when viewed from the end of the fatty acid chain). Suitable omega-6 fatty acids include linoleic acid, gamma-linolenic acid, eicosadienoic acid, dihomo-gamma-linolenic acid, arachidonic acid, docosadienoic acid, adrenic acid, docosapentaenoic acid, calendic acid, and mixtures thereof. Preferably, the agents contain 0.1 wt % to 10 wt %, particularly 0.5 wt % to 6 wt % omega-6 fatty acid, based on total weight of the agent. Agents containing linoleic acid are especially preferred.

The agents preferably contain 80 wt % to 94 wt % water. They can additionally contain water-miscible solvent(s), particularly alcohols having 1 to 4 carbon atoms such as methanol, ethanol, isopropanol, and tert-butanol, diols having 2 to 4 carbon atoms such as ethylene glycol and propylene glycol, as well as mixtures thereof, and ethers derivable from the aforesaid classes of compounds. Such water-miscible solvents are present in the agents preferably in quantities no greater than 5 wt %, particularly from 0.1 wt % to 2 wt %, based on total weight of the agent. Preferred agents contain alcohols having 1 to 4 carbon atoms, especially ethanol.

Agents according to the present invention can additionally contain complexing agents for metal ions. Suitable complexing agents include alkali salts of ethylenediaminetetraacetic acid (EDTA) or nitrilotriacetic acid (NTA), as well as alkali-metal salts of anionic polyelectrolytes such as polymaleates and polysulfonates.

A preferred class of complexing agents is phosphonates. Included among these preferred compounds are organophosphonates such as 1-hydroxyethane-1,1-diphosphonic acid (HEDP), aminotri(methylenephosphonic acid) (ATMP), diethylenetriaminepenta(methylenephosphonic acid) (DTPMP or DETPMP), and 2-phosphonobutane-1,2,4-tricarboxylic acid (PBS-AM), which can also be used in the form of their ammonium or alkali-metal salts. Such complexing agents are present in the agents preferably in amounts no greater than 1 wt %, particularly from 0.05 wt % to 0.5 wt %, based on total weight of the agent.

Agents according to the present invention can also contain radical scavengers such as phenols, bisphenols, and thiobisphenols substituted with sterically hindered groups, butylhydroxytoluene (BHT), butylhydroxyanisole (BHA), t-butylhydroquinone (TBHQ), tocopherol, propyl gallate, and long-chain ($C_8$ to $C_{22}$) esters of gallic acid such as dodecyl gallate. The radical scavengers can be present in an amount of up to 1 wt %, particularly 0.01 wt % to 0.1 wt %. Preferred agents contain butylhydroxytoluene as a radical scavenger.

Agents according to the present invention are preferably weakly alkaline, having a pH in the range of from 8 to 10, preferably 8 to 9. To establish a desired pH value that is not due to the mixture of the other components, agents according to the present invention can contain systemically acceptable acids or bases such as ammonium hydroxides or alkali hydroxides.

If desired, the agents can also contain further ingredients common in textile pretreatment agents, provided they do not interact unreasonably with the active substances mentioned above. Scents may be mentioned here as an example.

The agents can be manufactured in uncomplicated fashion by simply mixing their ingredients. They are homogeneous systems with excellent shelf stability and good spot removal performance, with little textile damage potential and a high degree of skin compatibility. They can be used for spot-removing treatment of textiles stained in locally delimited fashion, with the agents being particularly preferred for removal of blood-containing stains on textiles. According to the procedure for removing locally delimited stains on textiles, a liquid agent according to the present invention is applied in undiluted fashion, for example, with the aid of a cloth or sponge, onto the stained portion of the textile containing the spot to be removed; allowing it to act on the textile (which can still be on the human body), preferably only long enough that it does not dry; and removing it, preferably with the aid of a textile cloth, sponge, or paper towel. This procedure can be repeated if applicable. If desired, the agent can also be applied in the form of foam onto the portion of the textile to be cleaned. A manually activated spray dispenser chosen from aerosol spray dispensers, self-pressurizing spray dispensers, pump spray dispensers, and trigger spray dispensers, is suitable, for example, for applying the foam. It is also possible to add the agent as an additive to a washing agent for automatic laundering of textiles.

EXAMPLES

Liquid bleaching-agent-containing laundry treatment agents B1 to B4 were manufactured by simply mixing the ingredients indicated in the table below in the quantitative proportions indicated (wt % based on the complete agent).

| | B1 | B2 | B3 | B4 |
|---|---|---|---|---|
| Linoleic acid | 6 | 6 | 6 | 6 |
| Sodium hydroxide | 0.48 | 0.87 | 0.85 | 0.48 |
| Hydrogen peroxide | 0.9 | 0.9 | 0.9 | 2 |
| Ethanol | 1.8 | 1.8 | 1.8 | 1.8 |
| butylhydroxytoluene (BHT) | 0.1 | 0.1 | 0.1 | 0.1 |
| Diethylenetriaminepenta-methylenephosphonic acid | — | — | 0.2 | — |
| Water | | to 100 | | |

300 μl of blood was applied into the center of a cotton textile specimen. 200 μl of agent B1 was applied onto the blood-stained area of the textile and rubbed in with a paper towel. Application of the agent was repeated until the originally stained location was decolored. A maximum of approximately 2 ml of the agent was required for this. Substantially the same result was obtained using agents B2 to B4.

We claim:

1. Liquid hydrous laundry treatment agent consisting of:
hydrogen peroxide;
omega-6 fatty acid;
at least an alcohol having 1 to 4 carbon atoms or ethers derived therefrom;
a complexing agent;
a radical scavenger;
water; and
optionally, one or more components chosen from a pH adjuster or scent.

2. Agent according to claim 1, wherein the hydrogen peroxide is present in an amount of; from 0.1 wt % to 5 wt % based on the total weight of the agent.

3. Agent according to claim 1, wherein the omega-6 fatty acid is present in an amount of 0.1 wt % to 10 wt % based on total weight of the agent.

4. Agent according to claim 1 wherein the omega-6 fatty acid is linoleic acid.

5. Agent according to claim 1 wherein the water-miscible solvent is present in an amount of from 0.1 to 5 wt % based on the total weight of the agent.

6. Agent according to claim 1 wherein the complexing agent is present in an amount of from 0.05 to 1 wt % based on the total weight of the agent.

7. Agent according to claim 1 wherein the radical scavenger is present in an amount of from 0.01 to 1 wt % based on the total weight of the agent.

8. Agent according to claim 1, wherein the agent has a pH in a range of from 8 to 10.

9. Method for removing locally delimited stains from textiles comprising applying, in undiluted fashion, a liquid hydrous laundry treatment agent consisting of:
hydrogen peroxide;
omega-6 fatty acid;
at least an alcohol having 1 to 4 carbon atoms or ethers derived therefrom;
a complexing agent;
a radical scavenger;
water; and
optionally, one or more components chosen from a pH adjuster or scent;
onto a stained portion of the textile encompassing the spot to be removed, allowing the liquid hydrous laundry treatment agent to act on the textile, and
removing the liquid hydrous laundry treatment agent from the textile with the aid of a textile cloth, a sponge, or paper towel.

10. Method according to claim 9, wherein the stained portion is a blood-containing stain.

11. Method according to claim 9, wherein the spot is completely removed in the absence of washing of the entire textile.

* * * * *